US005127381A

United States Patent [19]

Kupzik et al.

[11] Patent Number: 5,127,381

[45] Date of Patent: Jul. 7, 1992

[54] FUEL INJECTION PUMP FOR INTERNAL COMBUSTION ENGINES

[75] Inventors: Roland Kupzik, Stuttgart; Eberhard Schunck, Landau, both of Fed. Rep. of Germany

[73] Assignee: Robert Bosch GmbH, Stuttgart, Fed. Rep. of Germany

[21] Appl. No.: 477,972

[22] PCT Filed: Aug. 17, 1989

[86] PCT No.: PCT/DE89/00538

§ 371 Date: May 17, 1990

§ 102(e) Date: May 17, 1990

[87] PCT Pub. No.: WO90/07055

PCT Pub. Date: Jun. 28, 1990

[30] Foreign Application Priority Data

Dec. 22, 1988 [DE] Fed. Rep. of Germany ..... 3843162

[51] Int. Cl.[5] ..... F02M 57/02

[52] U.S. Cl. ..... 123/467; 123/449; 123/503

[58] Field of Search ..... 123/467, 449, 503, 501, 123/500

[56] References Cited

U.S. PATENT DOCUMENTS

| | | | |
|---|---|---|---|
| 3,758,241 | 9/1973 | Eheim | 123/449 |
| 3,908,619 | 9/1975 | Bittelmeyer | 123/503 |
| 4,476,835 | 10/1984 | Laufer | 123/503 |
| 4,711,221 | 12/1987 | Laufer | 123/467 |
| 4,788,959 | 12/1988 | Iiyama | 123/449 |
| 4,798,186 | 1/1989 | Ganser | 123/467 |
| 4,969,442 | 11/1990 | Taue | 123/467 |

FOREIGN PATENT DOCUMENTS

| | | | |
|---|---|---|---|
| 3329384 | 2/1985 | Fed. Rep. of Germany | 123/449 |
| 3336869 | 4/1985 | Fed. Rep. of Germany | 123/449 |

*Primary Examiner*—Carl S. Miller
*Attorney, Agent, or Firm*—Michael J. Striker

[57] ABSTRACT

A fuel injection pump for internal combustion engines includes a cylinder sleeve having a first bore and a damping space communicating with the suction space of the pump, and plunger having a smaller diameter portion extending into the bore and displaceable therein to effect delivery of fuel to the internal combustion engine. The fuel injection pump further includes a cam drive for displacing the plunger and a return spring for biasing the plunger to an initial suction position thereof and into engagement with the cam drive. The plunger has a larger diameter portion extendable into the damping space during a delivery stroke for adjusting a volume of the damping space and defining at an end of the delivery stroke, a throttle gap that forms a sole connection between the dampening space and the suction space of the pump.

4 Claims, 2 Drawing Sheets

FUEL INJECTION PUMP FOR INTERNAL COMBUSTION ENGINES

BACKGROUND OF THE INVENTION

The invention relates to a fuel injection pump including a stepped plunger movable by a cam drive and having a reduced diameter portion for executing suction and delivery strokes and an end face for limiting the pump working space. The end face has a damping space connected with the suction space of the pump and whose volume can be changed. DE-OS 3,144,277 has already disclosed a fuel injection pump which, in order to increase the power by increasing the delivery rate of the pump plunger, has a hydraulic cushioning device in order to compliment the restoring forces required to decelerate the oscillating pump plunger, which restoring forces can no longer be produced by the helical springs which are supposed to hold the pump plunger in contact with the face cams. The known hydraulic cushioning device requires a restriction groove on the pump plunger in order to limit the outflow of the fuel from a damping space. The formation of the restriction groove on the pump plunger requires additional and, furthermore, cost-intensive operations since the restriction groove must usually be produced by erosion. Furthermore, the braking effect affects the majority of the pump plunger movement, with the result that the driving forces required are higher than necessary.

SUMMARY OF THE INVENTION

The object of the invention is a fuel injection pump in which a further increase in the velocity of the pump plunger and hence an increase in the power of the fuel injection pump is possible even though the hydraulic stop does not have an additional compensating groove and the braking effect occurs only partially in the region of the top dead centre of the pump plunger. The object of the invention is achieved by providing a damping face on the plunger portion having a larger diameter and which, at the end of the delivery stroke, is brought into the damping space and forms a throttle gap forming a connection with the suction space. It is advantageous to have the braking effect occur only in the event of the pump plunger or the camshaft driving the latter actually lifting off from the roller ring at high rotational operating speed. It is particularly advantageous here that the delivery stroke pressure and the braking pressure on the pump plunger occur temporally in succession and transverse forces, which can cause the jamming of the pump plunger, are thus avoided.

The present invention both as to its construction and its method of operation, together with additional objects and advantages thereof, will be best understood from the following detailed description of the preferred embodiment when read in connection with the accompanying drawings.

DESCRIPTION OF THE PREFERRED EMBODIMENT

Figure 1:
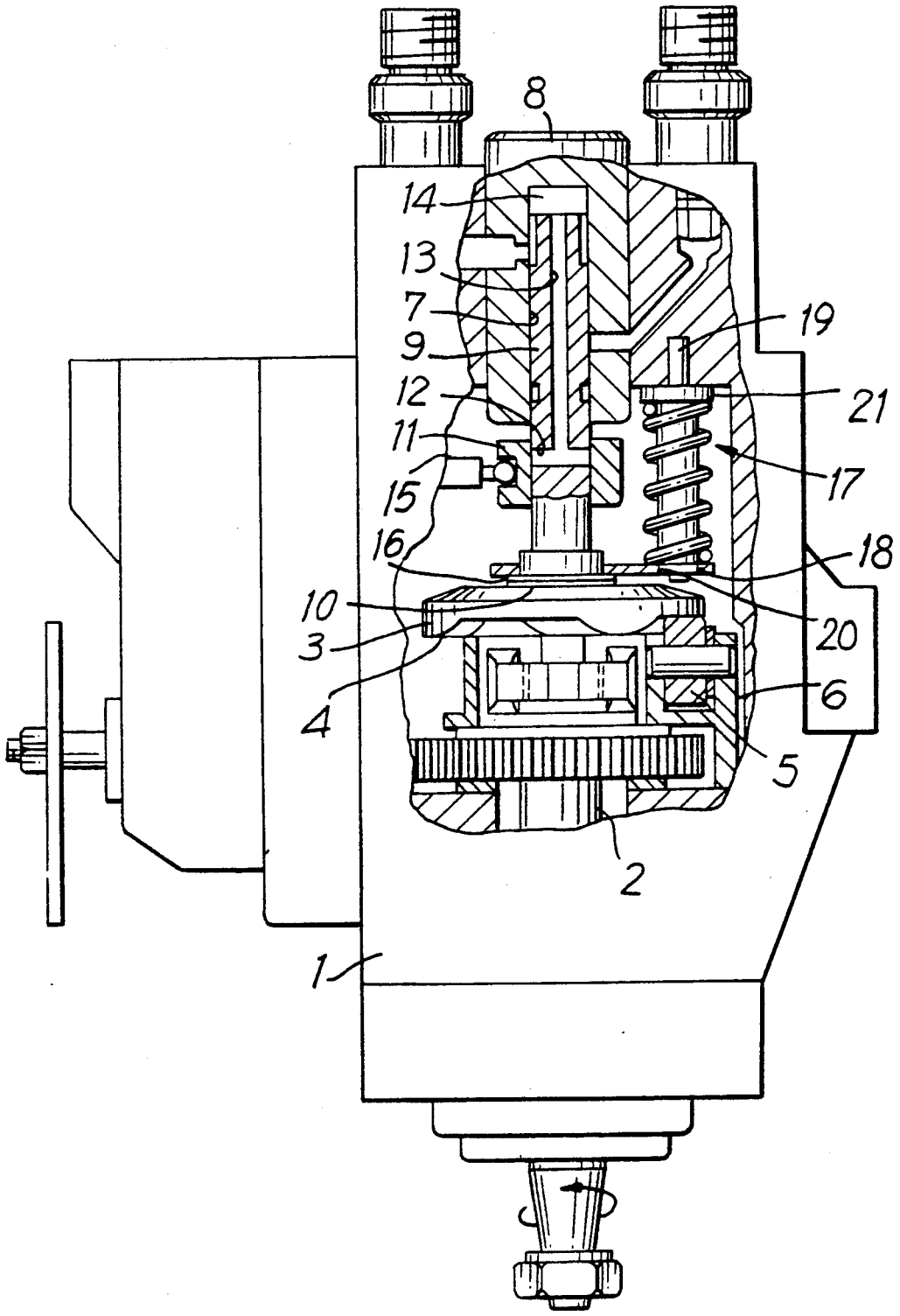
FIG. 1 shows a simplified partially cross-sectional side view of a fuel injection pump, according to the invention

The drawing shows in FIG. 1, a simplified partially cross-sectional view of a distributor-type fuel injection pump in which a drive shaft 2 is mounted in a housing 1 and to which a lifting disc 3 arranged transversely to the drive shaft 2 is coupled: The lifting disc is provided with face cams 4 corresponding to the number of cylinders of the internal combustion engine which are to be supplied. The bearing surface of the lifting disc 3 runs on rollers 5, which are held in a fixed roller ring 6. At its driving-side end protruding into a fuel-filled suction space 26, a pump plunger 9, which slides in a bore 7 of a cylinder sleeve 8, has a collar 10, which is fixed to the lifting disc 3 for rotation therewith. To control the fuel injection quantity, a control slide 11 embracing the pump plunger 9 slides on the driving-side pump plunger portion, in which, for the purpose of controlled discharge of partial quantities of the fuel delivered, there is arranged a transverse bore 12 which is controlled by the control slide 11, is connected to a longitudinal bore 13 leading to the end face of the pump plunger 9 and there opens into a pump working space 14. Engaging the control slide 11 are adjusting means 15, the position of which is controlled in known manner by a speed governor. Resting against the collar 10 of the pump plunger 9 is a guiding blade 16, against which a yoke 18 loaded by at least one return spring 17 is biased. By way of simplification, only one return spring 17 is represented, but two or more return springs 17 are preferably provided. Extending coaxially to the return spring 17 is a guide pin 19, which is, on the one hand, secured in the housing 1 and, on the other hand, engages through a register plate 20, the yoke 18, the yoke 18 thus being secured against rotation. The return spring 17 is supported at one end with a spring plate 21 against the housing 1 and, at the other end, against the yoke 18, the lifting disc 3 thereby being pressed against the rollers 5. As the drive shaft 2 rotates, the pump plunger 9 is rotated concomitantly in the same way and additionally moved to and fro, the delivery stroke being effected by the face cams 4 of the lifting disc 13 counter to the action, of the return spring 17, and the suction stroke is effected by the stored force of the return spring 17.

Figure 2:
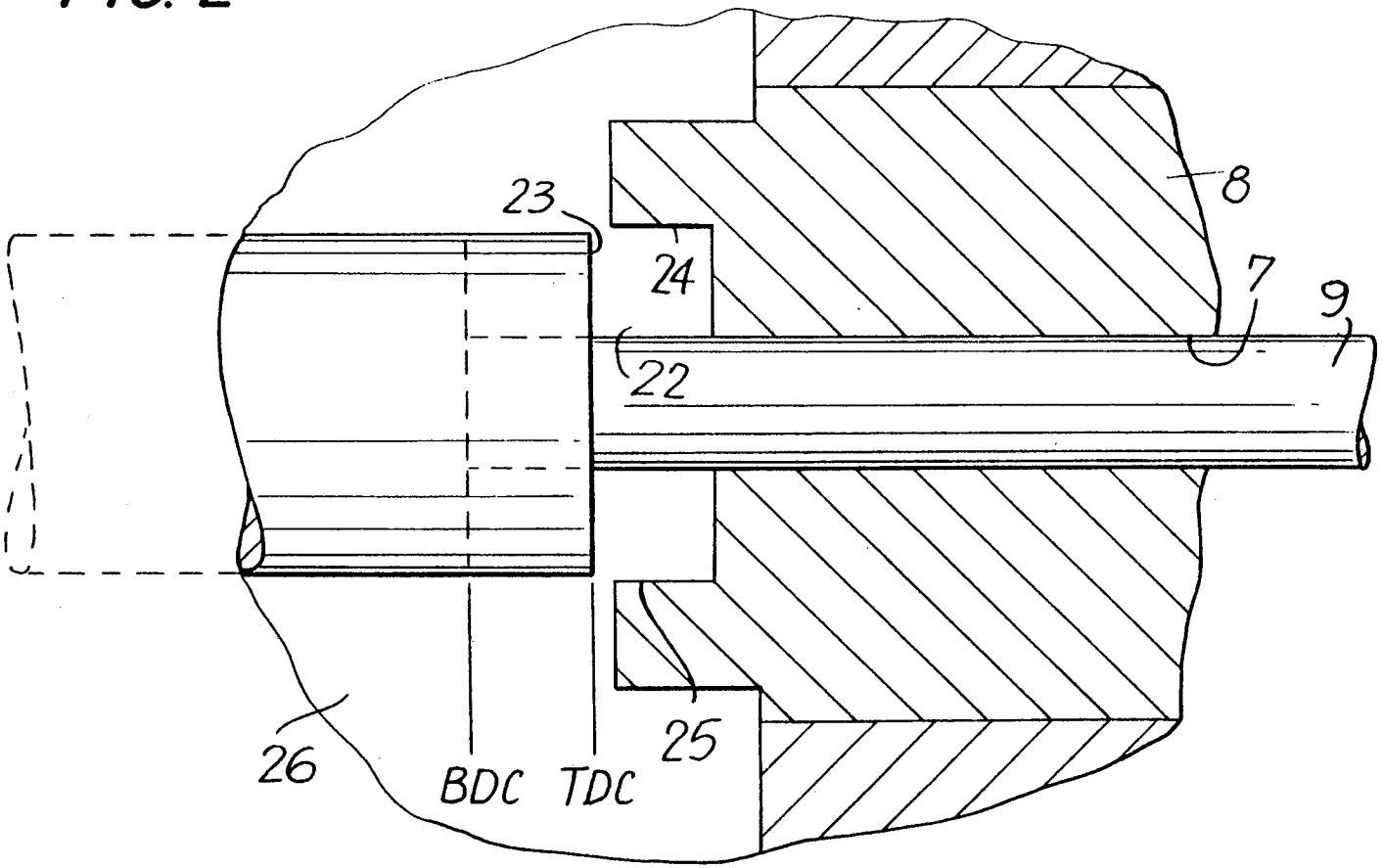
FIG. 2 shows in schematic partially cross-sectional view of a cylinder sleeve of the fuel injection pump according to the invention, with the pump plunger guided in the cylinder sleeve.

The illustrative embodiment represented in FIG. 2 shows a partial view of a fuel injection pump according to FIG. 1, modified in accordance with the invention. In this arrangement, the pump plunger 9 is of stepped design, the part of the pump plunger 9 of smaller diameter being slidingly guided in the bore 7 of the cylinder sleeve 8. The cylinder sleeve 8 has a damping bore 24, which is designed as a damping space, starts from the suction space, faces the part of the pump plunger 9 of larger diameter, and the axis of which coincides with the axis of the pump plunger 9. The annular front face between the large diameter and the small diameter of the pump plunger 9 forms a damping face 23. Within one cycle of movement, the pump plunger 9 assumes a lowermost motional position BDC and an uppermost motional position TDC. During a delivery stroke movement, the damping face 23 of the pump plunger 9 in contact with the face cams 4 approaches the forward limitation of the damping space 22 in TDC but for a small dimension which is less than 1 mm. If, in the case of high velocity, the inertial force of the pump plunger 9 exceeds the contact force of the return spring 17, the positive engagement between pump plunger 9 and face cam 4 is lost. As a result, shortly after BDC, the damping face 23 of the pump plunger 9 can enter the damping space 23, thereby forming an annular gap 25 between the circumferential surface of the part of the pump plunger 9 of larger diameter and the damping bore 24 bounding the damping space, which gap then forms the only connection between the damping space 22 and a fuel injection pump suction space 26 leading as a relief space. The throttling of the fuel enclosed in the damping space 22 leads to formation of a hydraulic spring, the return force of which is opposite to the movement of the pump plunger 9 and, after the delivery stroke movement of the pump plunger 9, assists, in the same direction, the actuating force of the return spring 17. To modify the return force or damping, different or additional throttling connections of the damping space 22 with the suction space 26 or other accumulating spaces can be provided in order to reduce the maximum pressure.

The functional sequence described results in the following sequence of actions. In TDC the outer contour of the face cam 4 has the smallest radius, with the consequence that the positively following pump plunger 9 here undergoes the greatest decelerations. In the illustrative embodiment described, a highly accelerated pump plunger 9 lifts off from the face cam 4 before TDC but, due to the damped braking, is quickly limited in its free flight shortly after TDC and rapidly guided back onto the face cam 4, the efficiency of the cam drive thereby being increased. The transverse forces caused by the delivery stroke pressure due to the torsion of the drive shaft 2 and to the displacements of the cam drive can cause pointwise wear which leads to sticking of the pump plunger 9. The separation, described above, of the positive engagement between the pump plunger 9 and face cam 4 prevents the influence of transverse force on the pump plunger before TDC; the bearing wear of the pump plunger 9 is thus largely circumvented. By virtue of the catching of the oscillating pump plunger 9 with a of hydraulic additional force in a manner according to the invention, the illustrative embodiment described permits, in combination with lower susceptibility to wear, higher delivery rates or driving speeds of the fuel injection pump, or higher numbers of strokes of the pump plunger per revolution for the same delivery quantity, this resulting in an increase in the power of the fuel injection pump.

While the invention has been illustrated and described as embodied in a fuel injection pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A fuel injection pump for internal combustion engines, comprising a suction space having a first bore and a damping space aligned to said bore and communicating with said suction space; a plunger having a smaller diameter portion extending into said first bore enclosing there a pump work chamber and displaceable therein to effect delivery of fuel out of the pump work chamber to the internal combustion engine, cam drive means for displacing said plunger; and spring means for biasing said plunger to an initial suction position thereof and into engagement with said cam drive means, said plunger having a larger diameter portion that adjoins to said smaller diameter portion adapted to pass into said damping space forming a throttling gap between its jacket face and the adjacent wall of said damping space that forms a sole connection between said damping space and said suction space; wherein said larger diameter portion only passes into said damping space consequent to a further movement of the plunger against said spring means after having reached its uppermost displacement in following a cam lobe.

2. A fuel injection pump as defined in claim 1; and further comprising a damping bore, said damping space being radially limited by said damping bore, said damping bore and said first bore of said cylindrical sleeve having same axes.

3. A fuel injection pump as defined in claim 1, wherein said damping face is formed by an annular face between said smaller diameter portion and said larger diameter portion of said plunger.

4. A fuel injection pump as defined in claim 1; and further comprising a damping bore which radially limits said damping space, said gap being formed by a movement play between a surface of said larger diameter portion of said plunger and said damping bore.

* * * * *